US010214997B2

(12) United States Patent
Lykkebo

(10) Patent No.: US 10,214,997 B2
(45) Date of Patent: Feb. 26, 2019

(54) DOWNHOLE CLEANING TOOL AND CLEANING METHOD

(71) Applicant: WELLTEC A/S, Allerød (DK)

(72) Inventor: Jesper Lundgaard Lykkebo, Allerød (DK)

(73) Assignee: Welltec A/S, Allerød (DK)

( * ) Notice: Subject to any disclaimer, the term of this patent is extended or adjusted under 35 U.S.C. 154(b) by 435 days.

(21) Appl. No.: 14/899,429

(22) PCT Filed: Jun. 26, 2014

(86) PCT No.: PCT/EP2014/063473
§ 371 (c)(1),
(2) Date: Dec. 17, 2015

(87) PCT Pub. No.: WO2014/207084
PCT Pub. Date: Dec. 31, 2014

(65) Prior Publication Data

US 2016/0145973 A1 May 26, 2016

(30) Foreign Application Priority Data

Jun. 27, 2013 (EP) ..... 13173976

(51) Int. Cl.
*E21B 10/32* (2006.01)
*E21B 37/02* (2006.01)
*E21B 43/12* (2006.01)

(52) U.S. Cl.
CPC ..... *E21B 37/02* (2013.01); *E21B 10/325* (2013.01); *E21B 43/128* (2013.01)

(58) Field of Classification Search
CPC ..... E21B 10/325; E21B 37/02; E21B 43/128
See application file for complete search history.

(56) References Cited

U.S. PATENT DOCUMENTS 4,648,447 A * 3/1987 Bishop ..... E21B 37/02 166/173
4,798,246 A * 1/1989 Best ..... B08B 9/0436 134/23

(Continued)

FOREIGN PATENT DOCUMENTS

CN 201818281 U 5/2011
CN 202611166 U 12/2012

(Continued)

OTHER PUBLICATIONS

International Preliminary Report dated Jan. 7, 2016 issued in International Application No. PCT/EP2014/063473 (8 pages).

(Continued)

*Primary Examiner* — Matthew R Buck
(74) *Attorney, Agent, or Firm* — Nixon & Vanderhye P.C.

(57) ABSTRACT

The present invention relates to a downhole cleaning tool for removing residues or precipitation solids on an inner face of a casing or liner. The downhole cleaning tool comprises a tool body having a bore and a wall, at least one inlet in the wall of the tool body, said inlet being fluidly connected with the bore, a solid removing element connected with the tool body for releasing solids of the inner face of the casing or liner, and a fluid cleaner section comprising a chamber, a filter within the chamber for separation of the solids from the fluid and a pump fluidly connected with the bore for sucking fluid with released solids in through the inlet into the chamber, wherein the solid removing element comprises at least one projecting part projecting from the tool body and a spring arranged between the tool body and the projecting part, and wherein the at least one inlet may be arranged adjacent the projecting parts for suction of released solids. Furthermore, the present invention relates to a downhole system and a cleaning method for removing residues or precipitation solids on an inner face of a casing or liner.

20 Claims, 7 Drawing Sheets

(56) References Cited

U.S. PATENT DOCUMENTS

| | | | | |
|---|---|---|---|---|
| 5,447,200 | A * | 9/1995 | Dedora | E21B 17/1057 166/105 |
| 6,484,802 | B1 * | 11/2002 | McGarian | E21B 37/02 166/173 |
| 6,695,058 | B1 * | 2/2004 | French | E21B 21/002 166/173 |
| 7,311,141 | B2 * | 12/2007 | Tulloch | E21B 37/02 15/104.16 |
| 7,559,374 | B2 * | 7/2009 | Telfer | E21B 37/02 166/172 |
| 7,905,291 | B2 * | 3/2011 | Kotsonis | E21B 37/00 166/311 |
| 2010/0258297 | A1 * | 10/2010 | Lynde | E21B 37/00 166/105.1 |
| 2012/0255724 | A1 * | 10/2012 | Hallundbæk | E21B 21/002 166/173 |

FOREIGN PATENT DOCUMENTS

| | | |
|---|---|---|
| GB | 2 411 920 | 9/2005 |
| RU | 2 099 507 C1 | 12/1997 |
| RU | 52 912 U1 | 4/2006 |
| SU | 1750750 A1 | 7/1992 |
| SU | 1 736 223 A1 | 11/1995 |
| WO | 2008/104177 | 9/2008 |
| WO | WO 2008/104177 | 9/2008 |

OTHER PUBLICATIONS

Notification of the First Office Action dated Apr. 6, 2017 in Chinese Application No. 201480033539.5, with English Translation (17 pages).

International Search Report for PCT/EP2014/063473, dated Aug. 25, 2014, 3 pages.

Written Opinion of the ISA for PCT/EP2014/063473, dated Aug. 25, 2014, 6 pages.

Decision on Patent Grant for Invention dated Feb. 1, 2018 in Russian Application No. 2016100539/03(000700), with English translation (22 pages).

* cited by examiner

DOWNHOLE CLEANING TOOL AND CLEANING METHOD

This application is the U.S. national phase of International Application No. PCT/EP2014/063473 filed 26 Jun. 2014, which designated the U.S. and claims priority to EP Patent Application No. 13173976.5 filed 27 Jun. 2013, the entire contents of each of which are hereby incorporated by reference.

FIELD OF THE INVENTION

The present invention relates to a downhole cleaning tool, a downhole system and a cleaning method for removing residues or precipitation solids on an inner face of a casing or liner.

BACKGROUND ART

Scale or the like precipitates on the inner surface of a casing or liner in a well, and brushes and even drilling bits are used to remove the scale. However, the scale is not easily removed and small amounts of scale often remain. This is due to the fact that the scale, when precipitating, binds very firmly to the inner surface, so that the scale comes off in layers, leaving a thin layer behind. Also, when performing a cement job where cement is pushed down the casing, a small layer of cement is often left behind, since the pushing plug cannot fully scrape the cement off the casing as it moves down the casing. Since a tubular casing may be slightly oval, the cement pushing plug and the brushes or other known tools are not very good at compensating for the resulting variations in diameter when trying to remove the scale or cement.

SUMMARY OF THE INVENTION

It is an object of the present invention to wholly or partly overcome the above disadvantages and drawbacks of the prior art. More specifically, it is an object to provide an improved scale removing tool capable of removing a thin layer, also in oval casing parts.

The above objects, together with numerous other objects, advantages and features, which will become evident from the below description, are accomplished by a solution in accordance with the present invention by a downhole cleaning tool for removing residues or precipitation solids on an inner face of a casing or liner, comprising:

- a tool body having a bore and a wall,
- at least one inlet in the wall of the tool body, said inlet being fluidly connected with the bore,
- a solid removing element connected with the tool body for releasing solids of the inner face of the casing or liner, and
- a fluid cleaner section comprising:
  - a chamber,
  - a filter within the chamber for separation of the solids from the fluid, and
  - a pump fluidly connected with the bore for sucking fluid with released solids in through the inlet into the chamber, wherein the solid removing element comprises at least one projecting part projecting from the tool body and a spring arranged between the tool body and the projecting part, and wherein the at least one inlet may be arranged adjacent the projecting parts for suction of released solids.

The projecting part may be arranged in a groove in the tool body.

Moreover, the projecting part may project radially from the tool body.

Furthermore, the projecting part may be radially movable in relation to the tool body.

Also, the projecting part may comprise bits arranged facing the casing.

In addition, the radially movable projection part may be connected with the tool body by means of a restricting element, so that the spring forces the projection part radially outwards to have a distance to an outer face of the tool body.

Moreover, the projecting part may be adapted to tilt in relation to a centre axis of the tool body.

Further, the spring may be a helical spring.

The windings of the spring may be spaced apart in a relaxed condition.

Also, the tool may comprise a plurality of inlets.

Furthermore, the tool body may be tubular having a longitudinal extension.

Additionally, the projecting part may have an increasing thickness along an axial extension of the tool body.

Moreover, the tool may comprise a plurality of projecting parts arranged spaced apart along a circumference of the tool body.

Further, the spring may be releasably arranged in bores in the tool body in the groove to maintain the spring in position.

Also, the spring may be releasably arranged in bores in the projecting part to maintain the spring in position.

Furthermore, the tool body may be connected with the fluid cleaner section, so that the bore is connected with the chamber.

In addition, the solid removing element may be arranged furthest away from the wireline.

The solid removing element may be arranged furthest away from the wireline in relation to the fluid cleaner section.

Also, the inlets may be arranged between the projection parts along the circumference of the tool body.

The downhole cleaning tool as described above may further comprise a bit head arranged at a leading end of the tool body.

In addition, the tool body may be rotatable.

Moreover, the downhole cleaning tool may be a wireline tool.

Furthermore, the pump may be fluidly connected with an outlet of the fluid cleaner section.

Also, the bits may be made of tungsten carbide.

The downhole cleaning tool as described above may further comprise a driving unit, such as a downhole tractor, for propelling the tool forward in the casing.

The present invention also relates to a downhole system comprising the downhole cleaning tool as described above.

Further, the present invention also relates to a cleaning method for removing residues or precipitation solids on an inner face of a casing or liner, comprising the steps of:

- introducing a downhole cleaning tool as described above into the casing or liner,
- drilling into the solids for releasing the solids,
- sucking fluid containing the solids in through the inlet in the wall of tool body,
- filtrating the solids from the fluid in the filter, and
- pumping the filtrated fluid back into the casing through an outlet in the tool in an end of the tool closest to a wireline.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
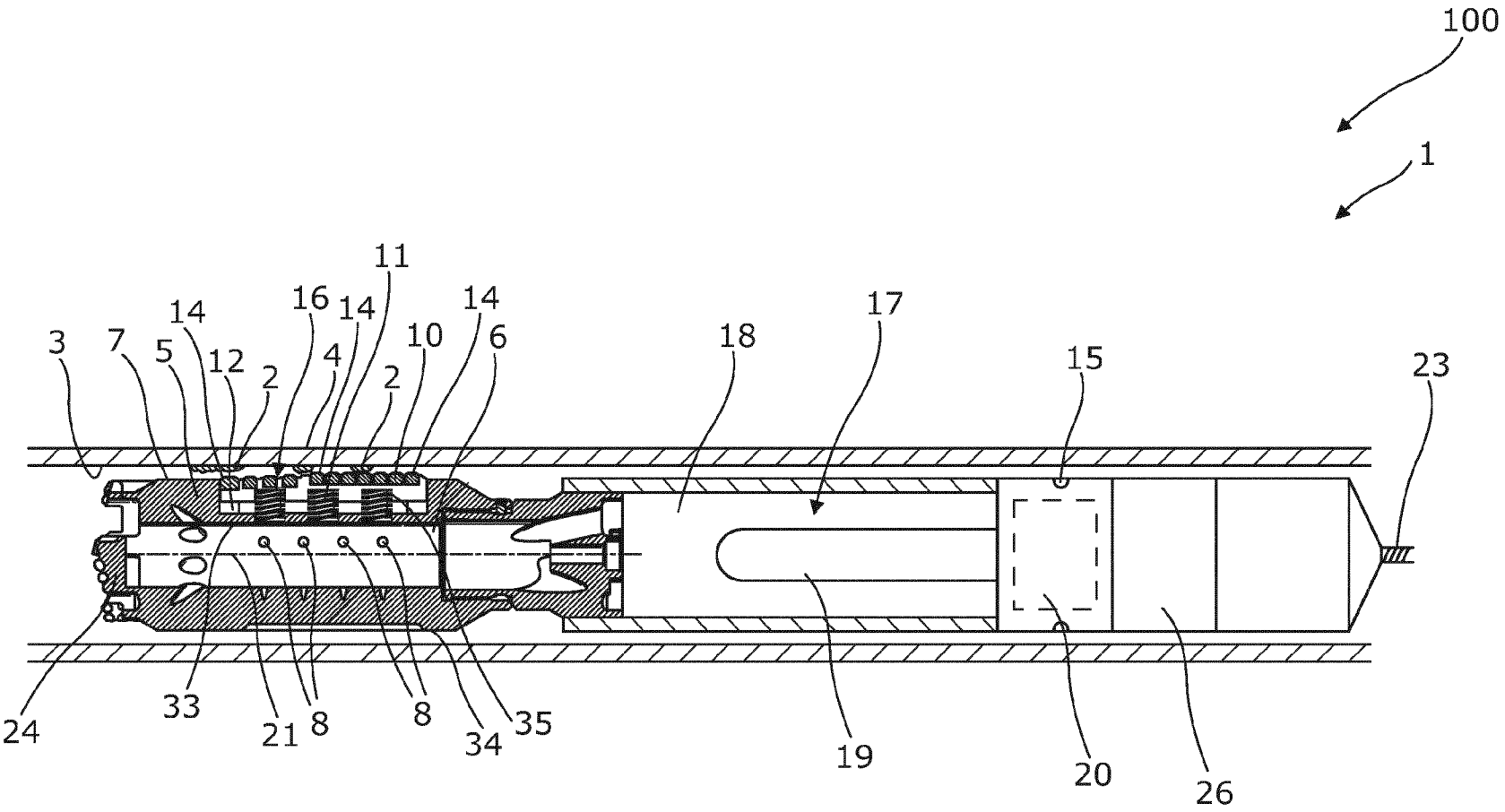
FIG. 1 shows partial, cross-sectional view of a downhole cleaning tool for removing solids on an inner face of a casing in a well.

FIG. 1 shows a downhole cleaning tool 1 for removing residues or precipitation 2 solids, such as scale or cement, on an inner face 3 of a casing 4 or liner in a well downhole. Scale is formed during production and cement comes from the cement job, during which the annulus outside of the casing or liner is filled with cement. The tool comprises a tool body 5, a solid removing element 16 and a fluid cleaner section 17. The tool body has a bore 6, a wall 7 and at least one inlet 8 in the wall, the inlet being fluidly connected with the bore. The solid removing element 16 is connected with the tool body for releasing solids off the inner face 3 of the casing or liner. Subsequent to being released from the inner face of the casing or liner, the solids are sucked into the fluid cleaner section, in which the released solids, cement or scale from the casing are filtered from the fluid. The fluid cleaner section 17 comprises a chamber 18, a filter 19 within the chamber for separation of the solids from the fluid, and a pump 20 fluidly connected with the bore for sucking fluid with released solids in through the inlet 8, via the bore 6, into the chamber.

The released solids are dispersed in the well fluid and are subsequently sucked into the chamber 18 of the fluid cleaner section and further in through the elongated filter 19. When passing the filter, the solids are separated from the fluid and accumulate in the annular part of the chamber, and the fluid is ejected through outlets 15 in the fluid cleaner section opposite the pump 20. The pump is driven by a motor 26 which is powered through a wireline 23.

The solid removing element 16 comprises at least one projecting part 10 projecting from the tool body and a spring 11 arranged between the tool body and the projecting part. In the cross-sectional view of FIG. 1, only one solid removing element 16 is shown which comprises one projection part.

When the solid removing element 16 is forced down into a casing, the solids providing an uneven casing press the projection part radially inwards to compress the spring. When part of the projecting part 10 of the solid removing element 16 subsequently passes the bump formed by the solids, that part of the projecting part is free and projects radially outwards again, so that the other part of the projecting part hits against the solids, and the solids are in this way knocked off the inner face of the casing.

In FIG. 1, the projecting part is arranged in a groove 12 in the tool body with a distance 28 (shown in FIG. 7) providing a clearance between the projecting part and the groove, so that the projecting part 10 is radially movable in the groove in relation to the tool body 5. The springs 11 are helical springs having windings which are spaced apart in a relaxed condition, hence providing the clearance. The projecting part comprises a plurality of bits 14 arranged facing the casing, so when the projecting part hits against the solids, the bits 14 function as a chisel for releasing the solids from the casing.

Figure 2:
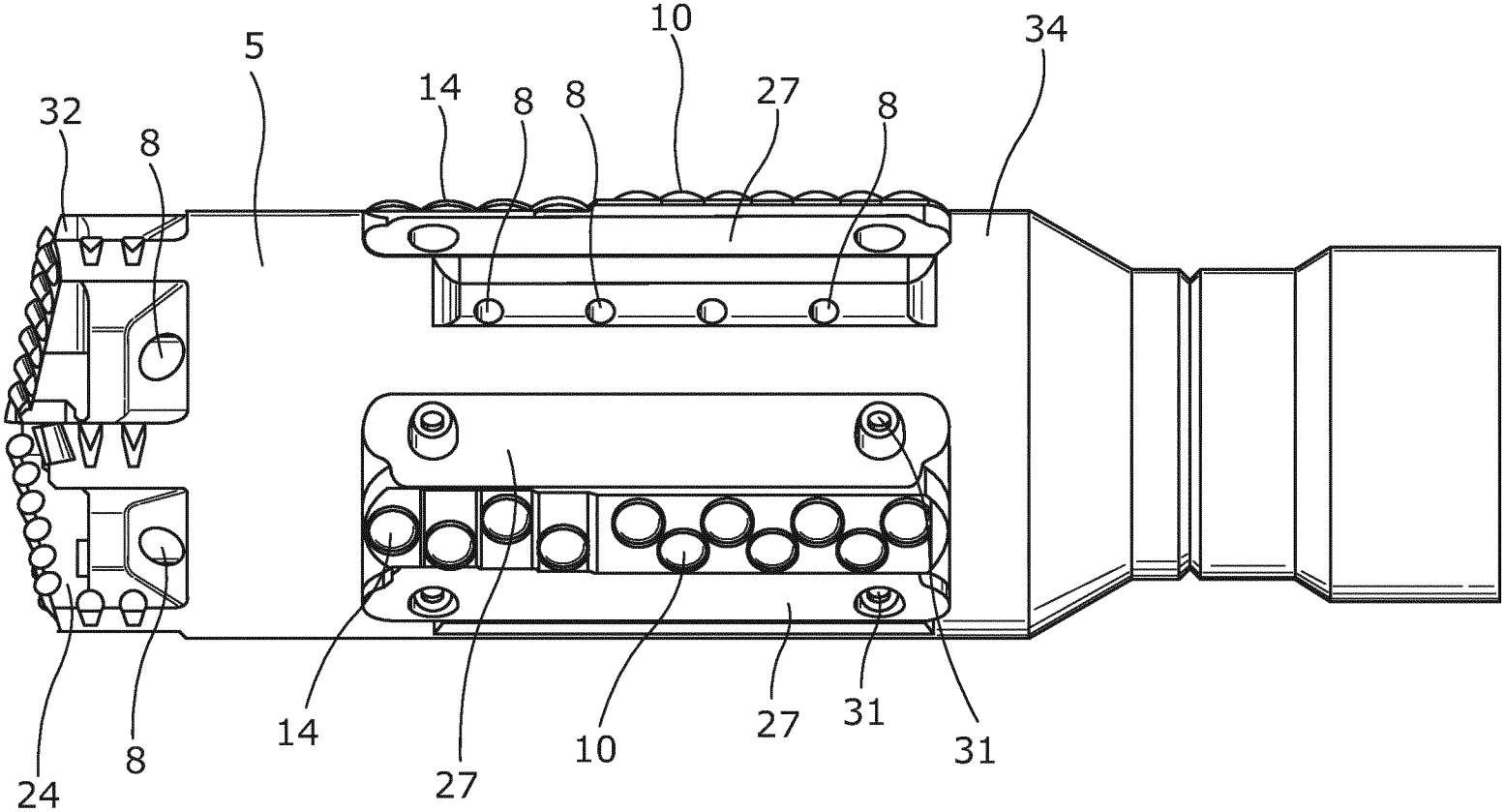
FIG. 2 shows a side view of the tool of FIG. 1 without a fluid cleaner section.
Figure 7:
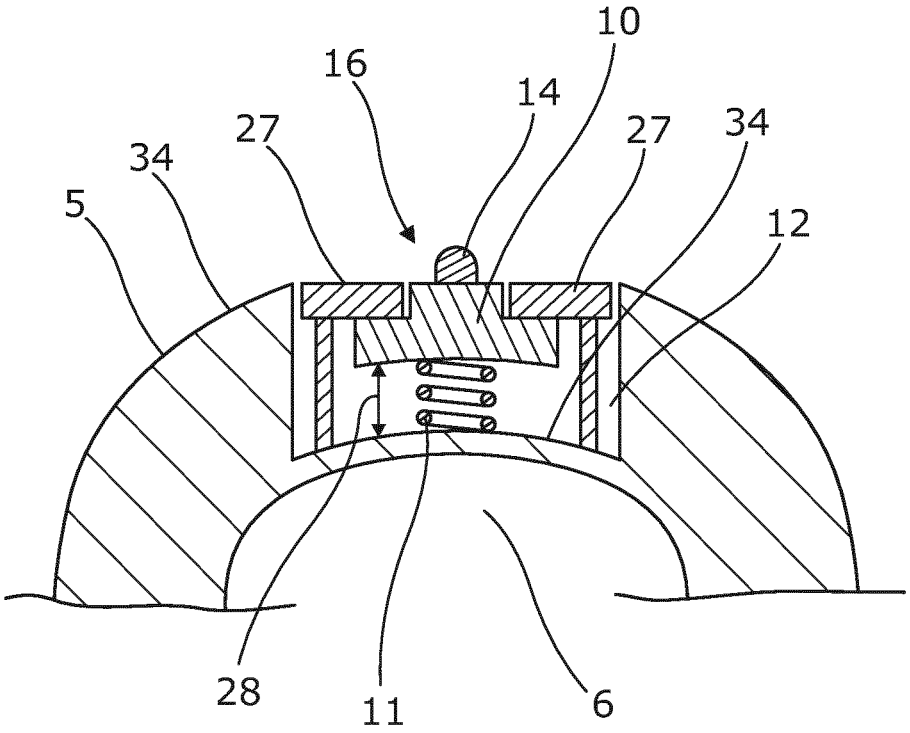
FIG. 7 shows a cross-sectional view of the downhole tool transverse to a longitudinal extension of the tool.

As can be seen in FIG. 2, the radially movable projection part 10 is connected with the tool body 5 by means of a restricting element 27 preventing the projection part 10 from departing radially from the tool body 5. The restricting element 27 is connected to the tool body by means of bolts 31. The spring arranged between the projection part 10 and the tool body 5 forces the projection part 10 radially outwards, providing the distance 28 to an outer face 34 in the groove 12 of the tool body, as shown in FIG. 7. Thus, the projecting part is adapted to tilt in relation to a centre axis 21 (shown in FIG. 1) of the tool body, both along a longitudinal extension and a circumference of the tool body.

Figure 3:
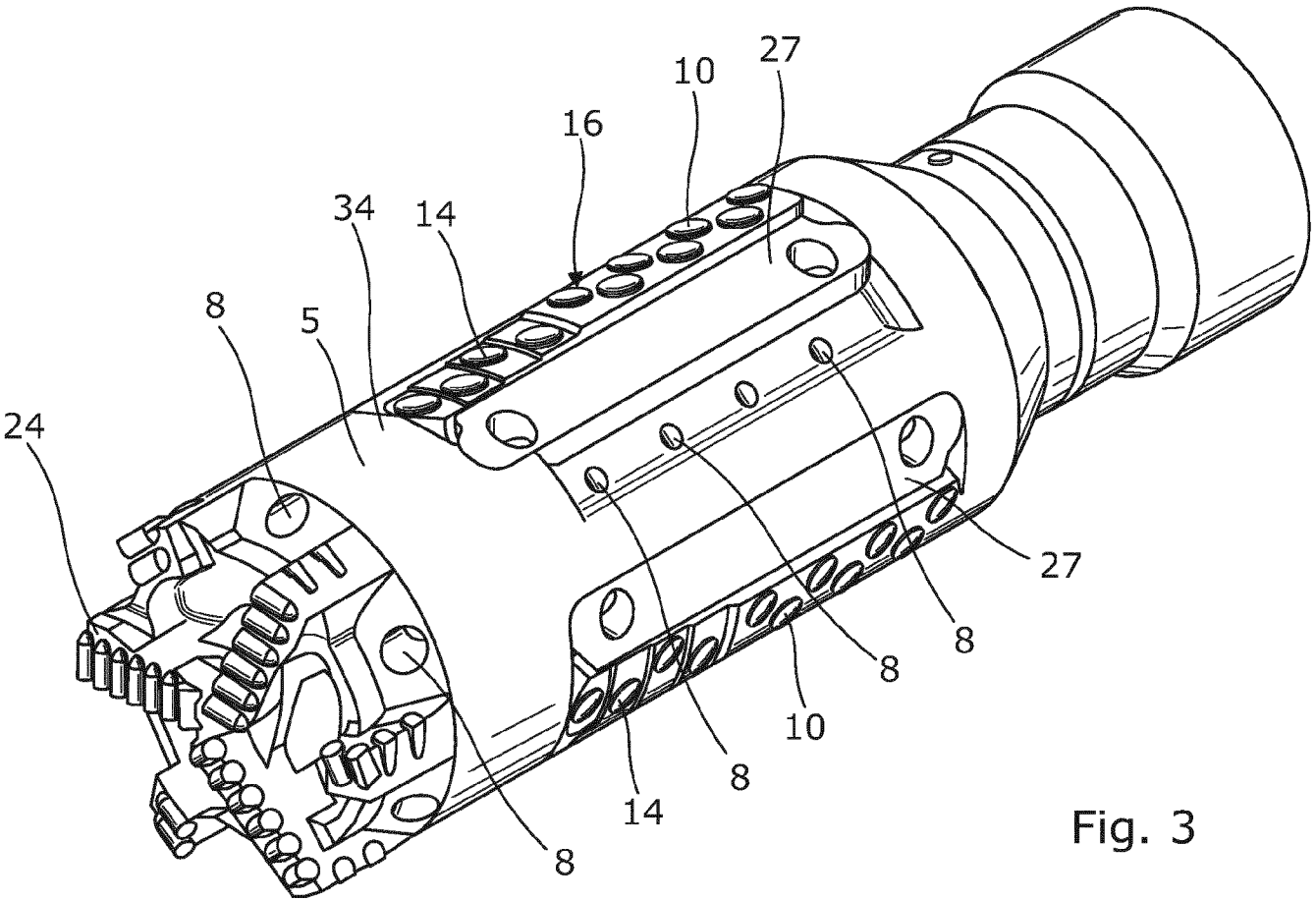
FIG. 3 shows a perspective of the tool of FIG. 1 seen from a leading end of the tool having a bit head.

The tool has several projecting parts arranged spaced apart along the circumference of the tool body 5, as shown in FIGS. 2 and 3. Thus, the projecting parts 10 are arranged along a circumferential side of the tool. The tool body 5 comprises a plurality of inlets 8 arranged in front of the tool and between the projecting parts and under the projection parts.

The tool further comprises a bit head 24 arranged at a leading end 32 of the tool body furthest away from the wireline. The bit head 24 may release parts of the solids and the projecting parts 10 release the remaining part of the solids. The tool body 5 is rotatable for drilling into the solids.

Figure 4:
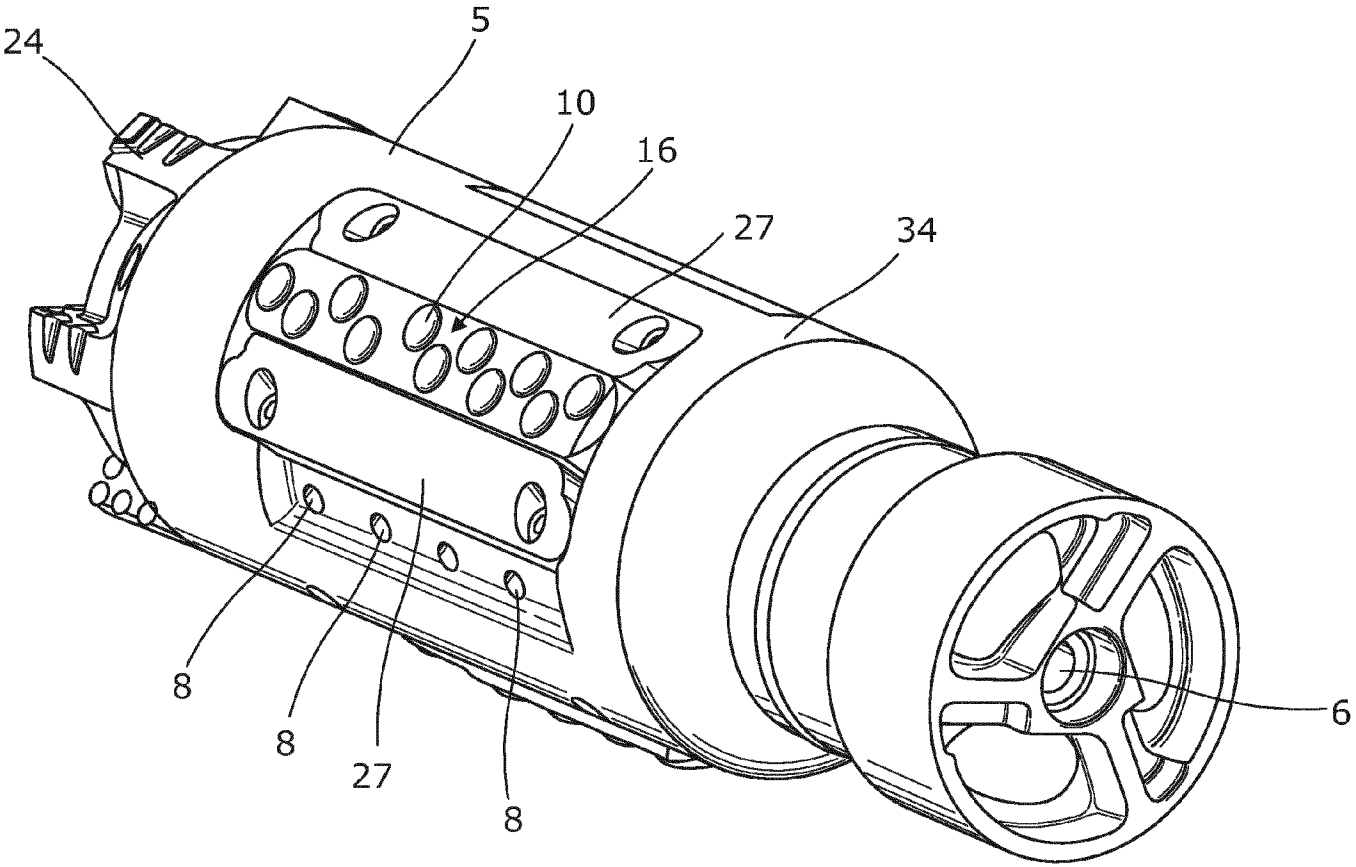
FIG. 4 shows a perspective of the tool of FIG. 3 seen from the end of the fluid cleaner.
Figure 5:
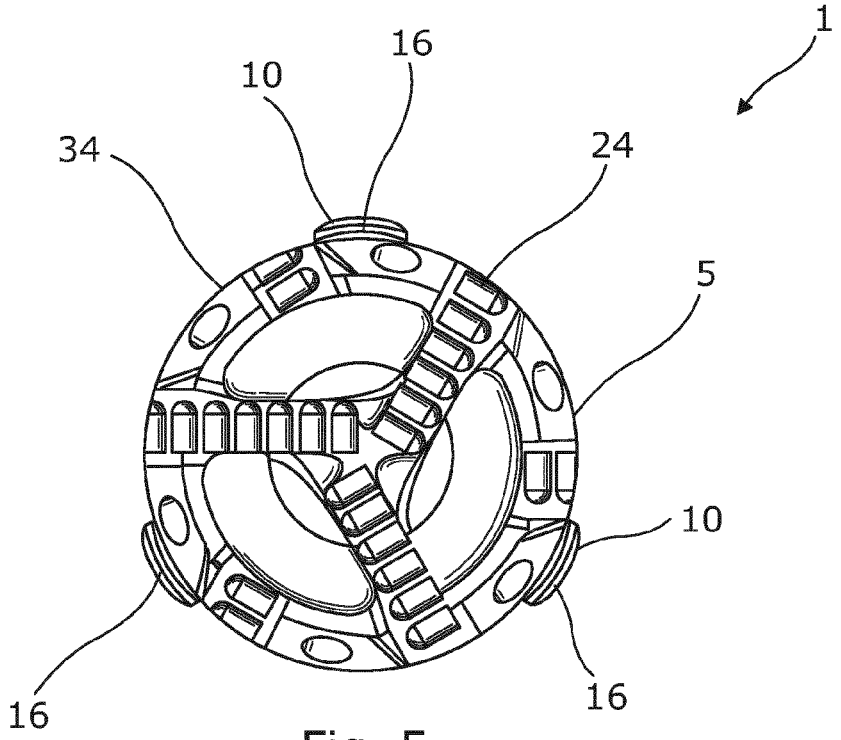
FIG. 5 shows the tool of FIG. 1 from the leading end.
Figure 6:
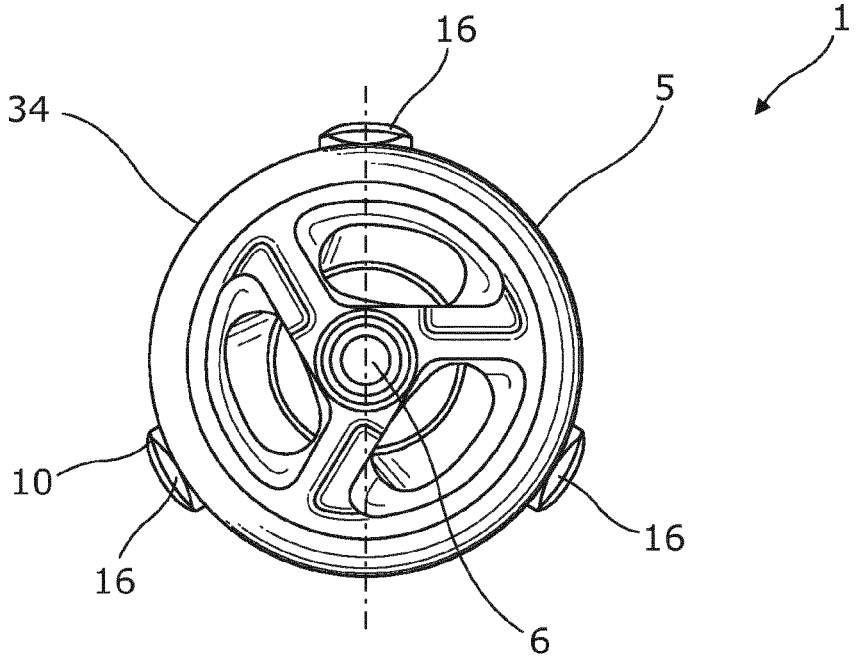
FIG. 6 shows the tool of FIG. 1 from the end which is to be connected with the fluid cleaner section.
Figure 8:
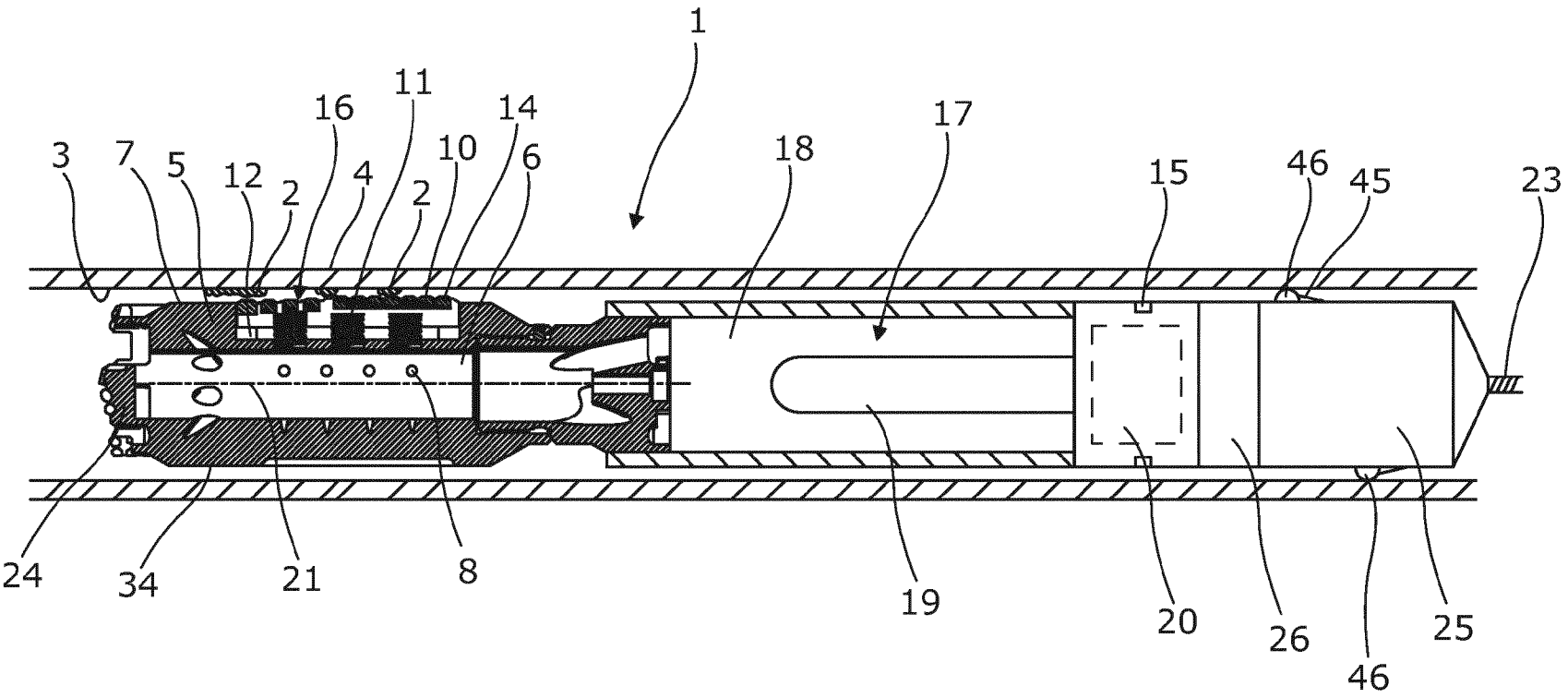
FIG. 8 shows a partial, cross-sectional view of another embodiment of the downhole tool.

Opposite the leading end, the tool body 5 is adapted to be connected with the fluid cleaner section as shown in FIGS. 4, 6 and 8. In FIGS. 5 and 6, the solid removing elements 16 with the projecting parts project from the outer face 34 of the tool body 5, but as shown in FIG. 4, the restricting element 27 does not project from the outer face 34 of the tool body 5.

In FIG. 7, only the bits 14 of the projecting part 10 project from the tool body. The projecting part 10 has a plate-shaped design, and the bits 14, e.g. made of tungsten carbide, may be moulded into the plate-shaped projecting part. As shown in FIG. 1, the projecting part has an increasing thickness along the longitudinal extension of the tool body 5, so that the outer diameter of the tool body increases from the leading end in the direction of the fluid cleaner section. In this way, the projecting part 10 is able to reach the inner face of the casing, irrespective of whether the casing is uneven or oval. The spring 11 is releasably arranged in bores 33 in the tool body in the groove and bores in the projecting part to maintain the spring in position. Furthermore, by having flexible projecting parts 10, the downhole cleaning tool 1 is capable of releasing solids in a casing having an oval cross-section.

The present invention also relates to a cleaning method for removing residues or precipitation solids 2 on an inner face 3 of a casing 4. First, a downhole cleaning tool 1 according to the present invention is introduced into the casing 4 and is moved inside in the casing. While the cleaning tool 1 is being moved inside the casing, solids 2 on the inner face 3 of the casing 4 are being drilled off and thereby removed by the solid removing element 16 of the cleaning tool 1. When the solids have been removed from the inner face 3, they are mixed with the fluid, and the fluid is sucked in through the inlet 8 in the tool body 5 and into the bore 6, and therefrom further into the chamber 18 of the fluid cleaner section 17 positioned downstream of the bore 6, so that the solids 2 are removed from the inside of the casing. In the chamber 18, the solids are filtrated from the fluid in the filter 19 and accumulated in the chamber 18. The filtrated fluid is then pumped back into the casing 4 through an outlet 15 in the cleaning tool 1 in an end of the tool closest to a wireline 23.

When the fluid is pumped into the casing 4 again, it will be directed to flow against a leading end of the cleaning tool towards the inlet 8 of the tool body, whereby the fluid is recirculated. From the outlet 15 to the inlet 8, the fluid will be mixed with the removed solids 2 from the inner face, and the fluid is then again sucked in through the inlet 8 in the tool body 5 and into the bore 6, and therefrom further into the chamber 18 of the fluid cleaner section 17 for filtration of solids from fluid as described above. These method steps will continue to be performed as long as the pump is sucking fluid into the tool body via inlet 8 and the cleaning tool is operating in the casing.

Furthermore, the step of filtrating the solids from the fluid is performed in the filter 19. The filter 19 has an elongated tubular extension in the chamber 18, whereby it is obtained that solids 2 do not accumulate in front of the filter and hence instead will be distributed around the filter, so that the fluid cleaner section has a high cleaning capacity.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tool is not submergible all the way into the casing, a driving unit 25, such as a downhole tractor as shown in FIG. 8, can be used to push the tool all the way into position in the well. The downhole tractor may have projectable arms 45 having wheels 46, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole cleaning tool for removing residues or precipitation solids on an inner face of a casing or liner, comprising:

a tool body having a bore and a wall, the bore defining a longitudinal axis, at least one inlet in the wall of the tool body, said inlet being fluidly connected with the bore, a solid removing element connected with the tool body for releasing solids on the inner face of the casing or liner, and a fluid cleaner section comprising:

a chamber, a filter within the chamber for separation of the solids from fluid containing the solids, and a pump fluidly connected with the bore for sucking fluid with released solids in through the inlet into the chamber, wherein the solid removing element comprises at least one projecting part projecting radially away from a circumferential outer face of the tool body and a spring arranged between the tool body and the projecting part, and wherein the at least one inlet is arranged adjacent the projecting part for suction of released solids in a radial direction transverse to the longitudinal axis.

2. A downhole cleaning tool according to claim 1, wherein the projecting part is radially movable in relation to the tool body.

3. A downhole cleaning tool according to claim 1, wherein the projecting part comprises bits arranged facing the casing or liner.

4. A downhole cleaning tool according to claim 2, wherein the radially movable projection part is connected with the tool body via a restricting element, so that the spring forces the projection part radially outwards to have a distance to the outer face of the tool body.

5. A downhole cleaning tool according to claim 1, wherein the projecting part has an increasing thickness along an axial extension of the tool body.

6. A downhole cleaning tool according to claim 1, wherein the tool comprises a plurality of projecting parts arranged spaced apart along a circumference of the tool body.

7. A downhole cleaning tool according to claim 1, wherein the spring is releasably arranged in a groove provided in the tool body, and an end of the spring is releasably received in a bore located within the groove to maintain the spring in position.

8. A downhole cleaning tool according to claim 1, wherein the spring is releasably arranged in a bore in the projecting part to maintain the spring in position.

9. A downhole cleaning tool according to claim 1, wherein the tool body is connected with the fluid cleaner section, so that the bore is connected with the chamber.

10. A downhole cleaning tool according to claim 1, wherein the solid removing element is arranged furthest away from a wireline provided for lowering the tool into the casing or liner.

11. A downhole cleaning tool according to claim 1, further comprising a bit head arranged at a leading end of the tool body.

12. A downhole cleaning tool according to claim 1, wherein the tool body is rotatable.

13. A downhole cleaning tool according to claim 1, wherein the downhole cleaning tool is a wireline tool.

14. A downhole cleaning tool according to claim 1, wherein the pump is fluidly connected with an outlet of the fluid cleaner section.

15. A downhole cleaning tool according to claim 3, wherein the bits are made of tungsten carbide.

16. A downhole cleaning tool according to claim 1, further comprising a driving unit configured to propel the tool forward in the casing or liner.

17. A downhole cleaning tool according to claim 1, wherein the at least one inlet is positioned circumferentially offset from the at least one projecting part, and an entry side of the at least one inlet is positioned further towards the filter compared to the at least one projecting part.

18. A downhole cleaning tool according to claim 1, wherein the at least one inlet is positioned within a recess or depression provided along the outer face of the tool body.

19. A downhole system comprising the downhole cleaning tool according to claim 1 and the casing or liner.

20. A cleaning method for removing residues or precipitation solids on an inner face of a casing or liner, comprising:

introducing the downhole cleaning tool according to claim 1 into the casing or liner, drilling into the solids for releasing the solids, sucking fluid containing the solids in through the inlet in the wall of the tool body, filtrating the solids from the fluid in the filter, and pumping the filtrated fluid back into the casing or liner through an outlet in the tool in an end of the tool closest to a wireline.

* * * * *